US007314118B2

(12) United States Patent
Husmann et al.

(10) Patent No.: US 7,314,118 B2
(45) Date of Patent: Jan. 1, 2008

(54) EQUIPMENT AND METHOD FOR VIBRATION DAMPING OF A LIFT CAGE

(75) Inventors: Josef Husmann, Lucerne (CH); Elena Cortona, Thalwil (CH)

(73) Assignee: Inventio AG, Hergiswil (CH)

( * ) Notice: Subject to any disclaimer, the term of this patent is extended or adjusted under 35 U.S.C. 154(b) by 545 days.

(21) Appl. No.: 11/018,714

(22) Filed: Dec. 21, 2004

(65) Prior Publication Data

US 2005/0145440 A1 Jul. 7, 2005

(30) Foreign Application Priority Data

Dec. 22, 2003 (EP) ..... 03405917

(51) Int. Cl.
*B66B 1/34* (2006.01)

(52) U.S. Cl. ..... 187/292; 187/409

(58) Field of Classification Search ..... 187/292, 187/391–394, 409, 410
See application file for complete search history.

(56) References Cited

U.S. PATENT DOCUMENTS 5,304,751 A 4/1994 Skalski et al.
5,652,414 A * 7/1997 Roberts et al. ..... 187/292
5,864,102 A * 1/1999 Jamieson et al. ..... 187/292
5,866,861 A * 2/1999 Rajamani et al. ..... 187/292
5,896,949 A 4/1999 Handy et al.
5,929,399 A * 7/1999 Jamieson et al. ..... 187/391
6,338,396 B1 * 1/2002 Morishita ..... 187/292
6,401,872 B1 * 6/2002 Morishita ..... 187/292
2001/0037916 A1 11/2001 Morishita
2004/0020725 A1 * 2/2004 Utsunomiya et al. ..... 187/292

* cited by examiner

*Primary Examiner*—Jonathan Salata
(74) *Attorney, Agent, or Firm*—Schweitzer Cornman Gross & Bondell LLP

(57) ABSTRACT

An improved equipment and method for reducing vibrations of a lift cage is intended for use in lifts of the type having a lift cage is intended for use in lifts of the type having a lift cage guided along rails in which a sensor for detecting positional changes of the lift cage and/or lift cage accelerations is coupled to a regulator which in turn controls an actuator for changing the position of the lift cage relative to the rails. An output signal developed by the regulator is limited to a maximum value for the setting signal to be sent to the actuator. A difference between the regulator output and the limited output is computed and fed to the regulator as an additional input. The regulator is constructed in such a manner that the difference fed back to the regulator remains as small as possible. This improves response of the vibration inducing equipment.

14 Claims, 2 Drawing Sheets

EQUIPMENT AND METHOD FOR VIBRATION DAMPING OF A LIFT CAGE

The invention relates to equipment as well as a method for reducing vibrations of a lift cage guided at rails.

BACKGROUND OF THE INVENTION

During travel of a lift cage in a lift shaft different forces can act on the cage body or a cage frame holding the cage body and excite the system into vibrations. The causes for the vibrations are, in particular, unevennesses in the guide rails as well as forces produced by the slipstream about the cage, which can readily cause the cage to oscillate in a horizontal direction or about one of the two horizontal axes or about a vertical axis. In addition, lateral traction forces transmitted by the traction cables or sudden positional changes of the load during travel can be the cause of transverse vibrations.

In order to increase the travel comfort for persons using the lift and also the safety of the system, regulating systems are used which seek to counteract the forces acting on the lift cage. For example, a system is known from U.S. Pat. No. 5,896,949 which comprises several guide elements connected to the lift cage movable between two end settings, wherein vibrations arising transversely to the travel direction are detected by several sensors mounted at the cage and used for controlling several actuators arranged between the cage and the guide elements. The actuators are controlled with the help of a regulating device in such a manner that they operate in opposition to the arising forces and thus suppress the vibrations as effectively as possible.

A typical characteristic of this method for active damping of vibrations in lift cages is that the regulator output or the setting signal for the electrical actuators has to be limited, since otherwise the risk of thermal overheating exists. In the publication "Thermal Protection of Electromagnetic Actuators" of E. Cortona there is described a method in which the above-mentioned limitation of the setting signal is designed to be variable and dependent on the temperature of the actuators. It is thereby ensured that the actuators are not damaged due excessive thermal loading.

A further typical characteristic of the above-mentioned method for active vibration is that the position regulator regulating the position of the lift cage has predominantly integrating behaviour. This has the consequence that, in the case of a constant regulating deviation, the output signal of the regulator is ever greater with time. If the above-mentioned method of limiting the setting signal is applied then it can occur that the output signal of the position regulator becomes greater so long as a comparatively large regulating deviation continues. If the regulating deviation becomes smaller, there is still too long a time until the setting signal again reaches the desired value.

BRIEF DESCRIPTION OF THE INVENTION

The present invention accordingly has the object of avoiding the aforesaid disadvantages. In particular, the object to be achieved is that the regulator, after reaching the limit of the setting signal, responds quickly and correctly again as soon as the position error decreases.

Thus, the object may be fulfilled by the invention in the form of equipment for reducing vibrations of a lift cage guided at rails or by a method for vibration reduction.

The solution according to the invention comprises feeding the difference between the output signal and the limited signal, i.e. the signal actually passed on to the actuators, back to the regulator as an additional input signal, wherein the regulator is constructed in such a manner that the fed-back difference remains as small as possible.

The measure according to the invention, which is also termed Anti-Reset Windup (ARW), makes it possible to so change the state magnitudes, which are not externally visible, of the regulator such that the stated difference between the actual output signal of the regulator and the limited output signal passed on to the actuators remains as small as possible. It is thereby ensured that the regulator responds very quickly again to changes of the system, particularly in such situations in which the position error diminishes again.

According to a preferred embodiment of the present invention, the feedback branch, which feeds the difference signal back to the regulator, contains a time delay block which transmits the difference signal delayed in time to the regulator. This ensures that a closed algebraic loop does not arise in the regulating system. The regulating equipment preferably operates in a time-discrete manner, wherein the time delay block transmits the difference signal back to the regulator delayed in time by a scanning period.

The maximum value to which the limiter unit limits the output signal issued by the regulator can in turn be temperature-dependent, wherein for this purpose the equipment comprises a temperature sensor which detects the temperature of the actuators, or a mathematical model which calculates temperature on the basis of the currents, the ambient temperature and the dissipation behaviour of the actuators.

The regulating equipment is preferably of a two-part design and comprises, on the one hand, a position regulator, which controls the actuators in such a manner that the guide elements adopt a predetermined position relative to the rails, as well as an acceleration regulator, which controls the actuators in such a manner that vibrations arising at the lift cage are suppressed. The signals from the position regulator and the acceleration regulator are in that case summed and then fed as a sum to the actuators. According to the invention, in this embodiment the above-mentioned limiter unit is provided with the feedback branch merely for the position regulator.

The regulating behaviour of a system for vibration damping can be significantly optimized in accordance with the invention, wherein it is ensured as before that the actuators are not overheated. The operational reliability of this system therefore remains guaranteed as unchanged.

BRIEF DESCRIPTION OF THE DRAWINGS

The invention is explained in more detail in the following on the basis of the accompanying drawings, in which.

DETAILED DESCRIPTION OF THE INVENTION

Before the regulating equipment according to the invention is explained by reference to FIGS. 2 and 3, the realization of an overall system for active damping of vibrations of a lift cage will be discussed by reference to FIG. 1.

Figure 1:
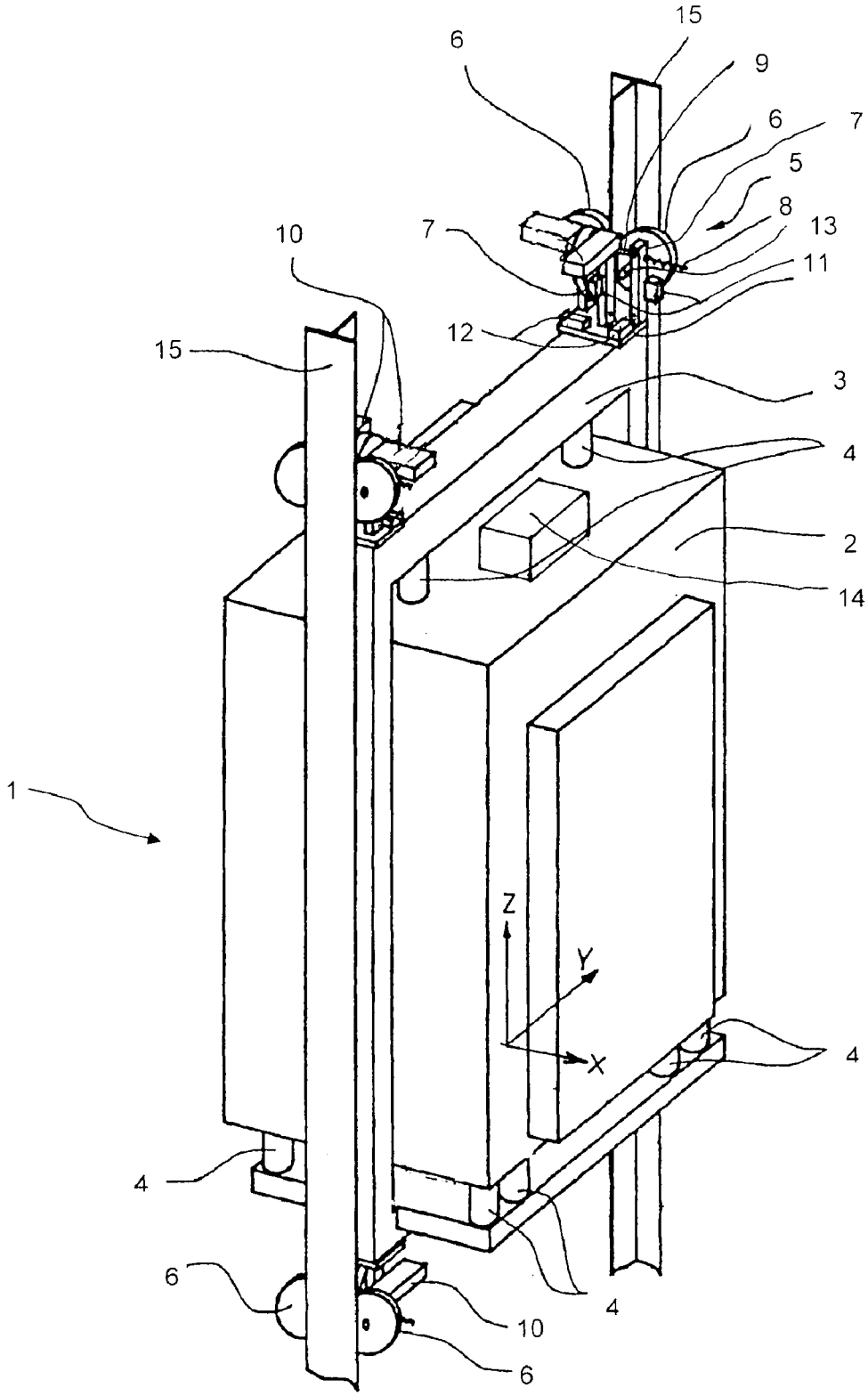
FIG. 1 is a schematic illustration of a lift cage guided at rails in which the regulating system according to the invention is used.

The cage illustrated in FIG. 1 and provided generally with the reference numeral 1 is divided into a cage body 2 and a cage frame 3. The cage body 2 is mounted in the frame 3 with the help of several rubber springs 4 which are provided for insulation of solid-borne sound. These rubber springs 4 are designed to be comparatively stiff in order to suppress the occurrence of low-frequency vibrations.

The cage 1 is guided, with the help of four roller guides 5, at the two guide rails 15 which are arranged in a lift shaft (not shown). The four roller guides 5 are usually of identical construction and are mounted laterally at the bottom and the top at the cage frame 3. They each have a respective post on which are mounted three guide rollers 6, i.e. two lateral rollers and one center roller. The guide rollers 6 are each movably mounted with the help of a respective lever 7 and are pressed by way of a spring 8 against a guide rail 15. The levers 7 of the two lateral guide rollers 6 are, in addition, connected together by way of a tie rod 9 so that they move synchronously with one another.

Two electrical actuators 10, which exert on the respective levers 7 a force acting parallel to the associated springs 8, are provided for each roller guide 5. A first actuator 10 moves the center lever 7 together with the associated center guide roller 6, whereas the second actuator 10 moves the two lateral levers 7 together with the associated lateral guide rollers 6. The setting of the levers 7 and the rollers 6 and thus the position of the lift cage 1 with respect to the guide rails 15 is thus controlled by the actuators 10.

The cage oscillations or vibrations to be damped by the equipment according to the present invention arise in the following five degrees of freedom:

displacements in the X direction
displacements in the Y direction
rotations about the X axis
rotations about the Y axis
rotations about the Z axis The different displacements or rotations in the five degrees of freedom are respectively attributable to a different mounting of the lift cage 1 at the four roller guides 5 in the X and/or Y directions.

In order to be able to detect vibrations of the cage 1 in all five degrees of freedom, there are provided two position sensors 11 per roller guide 5, i.e. a first sensor for detecting the position of the center lever 7 together with the associated guide roller 6, and a second sensor for detecting the position of the two lateral levers 7 together with the associated lateral guide rollers 6. In addition, each roller guide 5 is equipped with two horizontally oriented acceleration sensors 12, of which one detects accelerations in the displacement direction of the center guide roller 6 and the second detects accelerations perpendicularly thereto in the displacement direction of the two lateral guide rollers 6. The measurement signals of the sensors 11 and 12 give information about the current position of the lift cage 1 in relation to the two guide rails 15 and additionally inform whether the cage body 2 is currently subject to accelerations which can lead to vibrations.

Moreover, there is provided at one of the roller guides 5 (here at the righthand upper roller guide) a rotational movement sensor 13 which measures the rotational angle of a guide roller 6 associated therewith. The measurement values obtained by way of this rotational movement sensor 13 provide information about the travel path of the cage as well as about the current travel speed thereof in the vertical, thus in the Z, direction. A control device 14 fastened to the roof of the lift cage 1 processes the signals transmitted by the sensors 11 and 12 and, after evaluation of the sensor signals, with the help of the power unit, controls the electrical actuators 10 of the four roller guides 5 in order to counteract the accelerations and vibrations in a suitable manner.

Figure 2:
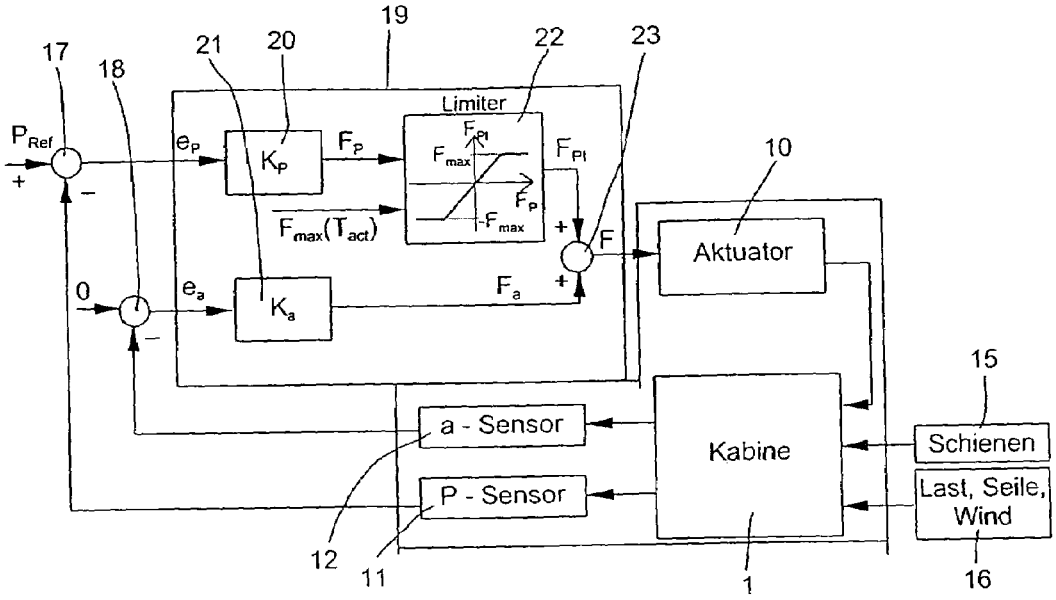
FIG. 2 is a signal flow diagram of a system for active vibration damping with a position regulator and an acceleration regulator usable in association with the invention.
Figure 3:
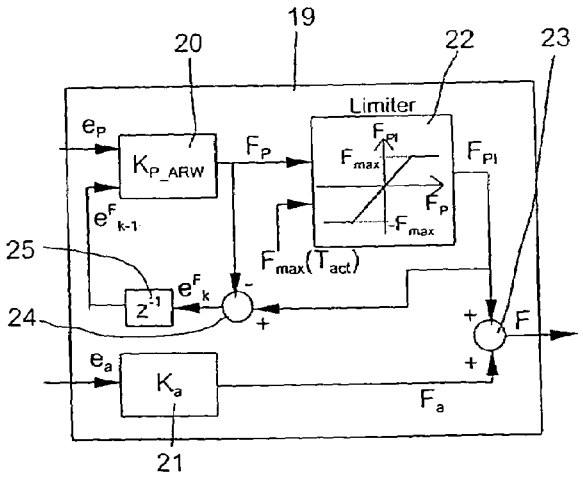
FIG. 3 shows a signal flow diagram of the regulating equipment designed in accordance with the invention.

FIGS. 2 and 3 show signal flow diagrams of the system according to the invention for active vibration damping. The basic build-up according to FIG. 2 substantially corresponds with the method as also used in U.S. Pat. No. 5,896,949. The illustrated signals are to be understood as being vector signals comprising several signals of like kind. The regulating equipment is designed as a so-termed MIMO (Multi-Input Multi-Output) regulator which, on the basis of a plurality of input signals, determines a plurality of setting signals for the actuators disposed at the roller guides.

In the system illustrated in FIG. 1, external disturbances act on the cage 1, which are composed of indirect disturbing forces from the rails 15 as well as disturbing forces 16 which engage directly at the cage 1, in the form of cage load, cable forces and wind forces. The current state of the cage is ascertained with the assistance of the position sensors 11 and acceleration sensors 12, wherein initially the positions measured by the position sensors 11 are compared in a summation block 17 to reference values which reproduce a reference setting of the cage 1 with respect to the rails 15. The result of the comparison/summation is an error signal or regulating deviation $e_p$, which describes the deviations of the positions of the roller guides with respect to the reference setting. In the summation block 18, the acceleration values of the acceleration sensors 12 are negated, i.e. subtracted from the ideal or reference value 0 (no accelerations), whereby a second error signal $e_a$ is produced.

The regulating equipment 19 is composed, as already mentioned, of two regulators, i.e. a position regulator ($K_p$) 20 as well as an acceleration regulator ($K_a$) 21. The basis for use of two separate regulators is that an objective of the regulating equipment 19 is to suppress cage vibrations in the high-frequency range (between 0.9 and 15 Hz, and preferably between 0.9 and 5 Hz) without the regulated lift having a worse behaviour outside this frequency range than an unregulated lift. On the other hand, the regulating equipment 19 has to ensure that the setting of the cage frame 3 with respect to the guide rails 15 is so regulated that a sufficient damping travel at the rails is available at any time. This is particularly important when the cage 1 is asymmetrically loaded.

For the first regulating purpose an acceleration or speed feedback with inertia sensors is sufficient, while for the second regulating objective position feedback is required. The two feedbacks have two opposing objectives, which are pursued by the use of the two separate regulators 20 and 21. As illustrated in FIG. 2, the position regulator 20 takes into consideration exclusively the measurement values of the position sensors 11 and is correspondingly responsible for maintenance of the guidance play of the cage 1. The acceleration regulator 21 processes the measurement values of the acceleration sensors 12 and is required for suppression of vibrations. The target or setting values of the two regulators 20 and 21 are summed in the summation block 23 and fed as a common setting signal to the actuators 10.

The solution for avoidance of the above-mentioned conflict between the two regulators 20 and 21 is based on the circumstance that the forces responsible for a skewed position of the cage 1 (a non-symmetrical loading of the cage, a large lateral cable force and the like) change substantially more slowly than the other sources of disturbance causing cage vibrations. These other sources are principally rail unevennesses or air disturbance forces. The amplification changes in the frequency range are always continuous, i.e. there are no fixed limits. At a defined frequency, the two regulators 20 and 21 have much the same influence. Above that frequency the acceleration regulator 21 acts more strongly and below that frequency the position regulator 20 acts more strongly.

The two above-mentioned regulating objectives can be pursued through division of the regulating equipment 19 into a position regulating circuit and an acceleration regulating circuit. A further advantage of the division is that the regulators 20 and 21 do not contain non-linearities. An analysis of stability and thus a corresponding configuring of the two regulators would otherwise be possible only with difficulty.

The output signal $F_P$ of the position regulator 20 in the present case is, however, initially fed to an additional limiter unit 22 which limits the signal to a maximum value $F_{max}$. The limited output signal $F_{PI}$, produced in this manner, for which $$F_{PI}=\max[\min(F_P, F_{max}), -F_{max}],$$

applies, is finally added in block 23 to the setting signal $F_a$ of the acceleration regulator 21 and fed to the actuator or actuators 10.

The maximum magnitude $F_{max}$ of the limiter unit 22 is dependent on the thermal loadability of the electrical actuators 10 and thus on the actual temperature $T_{act}$ thereof. For this purpose, temperature sensors (not illustrated in FIG. 1) are mounted at the actuators and transmit a corresponding signal to the regulating unit 19, which thereupon feeds to the limiter unit 22 the corresponding maximum value $F_{max}$ ($T_{act}$). The temperature $T_{act}$ can be determined by a mathematical model instead of by measuring. The model can take into consideration the electrical currents at the actuators 10, the ambient temperature and the dissipation behaviour of the actuators 10.

The limiting of the output signal of the position regulator 20 carried out in the foregoing manner has the consequence that the "theoretically optimum" setting signal $F_P$ determined by the regulator 20 continues to rise insofar as regulating deviations from the optimum position are present over a longer period of time. The reason for that resides in the fact the position regulator 20 has a predominantly integrating behaviour. The consequence thereof is that when the regulating deviation again diminishes there is too long a period of time until the output signal $F_P$ of the regulator 20 again reaches the desired value, thus until the regulator can react to the new situation. In order to circumvent this problem, according to the invention there is provided an extension of the regulating circuit which shall now be discussed by reference to FIG. 3. In that case the regulating circuit 19 is illustrated in FIG. 3; the further components of the signal flow diagram illustrated in FIG. 2 remain unchanged.

The extension according to the invention consists in that a feedback branch is provided by way of which a further input signal is fed to the position regulator 20. This further input signal is the difference between the output signal $F_P$ from the regulator 20 and the limited output signal $F_{PI}$ issued by the limiter unit 22. The two values are fed to a summation block 24 which forms the difference $e^F_k$. The error signal determined in this manner is then fed to a time delay block ($z^{-1}$) 25 which feeds back the signal delayed in time—preferably by a scanning period of the regulating equipment 19 operating in a time-discrete manner—as input signal $e^F_{K-1}$ to the position regulator 20. The time delay of this error signal is required so that a closed algebraic loop does not arise in the regulating system.

The position regulator 20 thus now receives, apart from the error signal $e_p$ with respect to the position of the cage 1, also a further input signal $e^F_{k-1}$ in the form of a difference signal between the output signal $F_P$ and the limited output signal $F_{PI}$. The regulator 20 is in that case conceived in such a manner that the difference signal $e^F_k$ remains as small as possible. The output signal $F_P$ of the position regulator 20 is thus limited only slightly by the limiter unit 22. It is thereby ensured that when the position error signal $e_p$ again adopts a smaller value after a transient period of time with higher deviations, the regulator can react as promptly as possible to the new situation. This is now possible, since it can no longer arise that the output signal of the regulator 20 significantly drifts out beyond the maximum value $F_{max}$ of the limiter unit 22.

The implementation of the feedback branch in the regulating equipment is achieved in that the position regulator 20 is extended by the so-termed Anti-Reset Windup (ARW) algorithm. This algorithm changes the internal state magnitudes x of the position regulator 20 in such a way that the difference signal $e^F_k$ remains as small as possible in the desired manner. The equations $$x_{k+1}=A^P x_k+B^P e_P$$

$$F_{P,k}=C^P x_k+D^P e_P$$

describing the linear behaviour of the position regulator are for that purpose extended by a so-termed ARW matrix $B^{ARW}$, whereby the following equation system describing the behaviour of the system to be regulated results:

$$x_{k+1} = A^P x_k + [B^P, B^{ARW}]\cdot\begin{bmatrix} e_P \\ e^F_{k-1} \end{bmatrix}$$

$$F_{P,k} = C^P x_k + [D^P, [0]]\cdot\begin{bmatrix} e_P \\ e^F_{k-1} \end{bmatrix}$$

The calculation of the ARW matrix is then carried out through the design of the regulator with the so-termed H∞ method. This is a known (for example from the publication 'Robuste Regelung' of Hans P. Geering, IMRT Press, Institut für Mess- und Regeltechnik der Eidgenössische Technische Hochschule, Zürich) method by which a regulator can be designed with knowledge of the behaviour of the system to be regulated; the principal advantage of the method resides in the fact that it can be automated to the greatest extent. In the present case, with the extended regulating circuit additional data are used which otherwise would remain unused. The use of the H∞ method and the calculation of the ARW matrix are also known from, for example, U. Christen: Engineering Aspects of H∞ Control, Diss. ETH No. 11433 (1996).

It is to be noted that in the case of the illustrated division of the regulating equipment into two regulating circuits, limiting and feedback, which is in accordance with the invention, are undertaken solely for the output signal of the position regulator, which in turn is connected with the integrating behaviour position of the regulator. Whereas the acceleration regulator has, as mentioned, the behaviour of a band-pass filter. Since the processes to be managed by the acceleration regulator are significantly faster than the positional changes of the cage for which compensation is to be provided by the position regulator, the risk does not exist that the actuators are permanently loaded in a one-sided manner by the setting signals of the acceleration regulator thus creating the risk of overheating.

Through the solution according to the invention it is thus ensured that the position regulator can, in a desired manner, rapidly react to changing conditions. In particular, with the help of the extension according to the invention the regulator rapidly attains the desired new setting value, even in the case of the position error signal adopting a higher value for a longer period of time, as soon as the position error signal drops back to a lower value. However, at the same time it is ensured that the setting signal of the regulator does not exceed the predetermined maximum values and thus the actuators do not run the risk of being damaged due to excessive thermal loading.

We claim:

1. Equipment for reducing vibrations of a lift cage guided at rails), comprising:

a plurality of guide elements for guiding the lift cage along the rails;

a sensor for detecting positional changes of the lift cage and/or accelerations occurring at the lift cage;

an actuator arranged between the lift cage and the guide elements; and a regulating device for controlling the actuator for changing the position of the cage relative to the rails on a basis of values transmitted from the sensor, the regulating device comprising a regulator for producing an output signal for controlling the actuator on the basis of values transmitted from the sensor, a limiter unit for limiting the output signal issued by the regulator to a maximum value and producing a setting signal to be issued by the regulating device, and a feedback branch by way of which a difference between the output signal of the regulator and a limited output signal produced by the limiter unit is fed to the regulator as a further input signal, the regulator being constructed such that the difference which is fed to the regulator remains as small as possible.

2. The equipment according to claim 1, characterized in that the feedback branch comprises a time delay block for delaying the transmission of the difference to the regulator.

3. The equipment according to claim 2, characterized in that the regulating equipment operates in time-discrete manner, wherein the delay imparted by the time delay block is a scanning period.

4. The equipment according to claim 1, 2 or 3, characterized in that the maximum value to which the limiter unit limits the output signal issued by the regulator is temperature-dependent.

5. The equipment according to claim 4, characterized in that the maximum value depends on a temperature of the actuator, wherein the equipment further comprises either at least one temperature sensor which detects the temperature of the actuator or means for calculating the temperature of the actuator though a mathematical thermal model.

6. The equipment according to claim 1, 2 or 3, characterized in that the regulating equipment comprises:

a position regulator which controls the actuator in dependence on signals from position sensors arranged at the lift cage in such a manner that the guide elements adopt a predetermined position; and an acceleration regulator which controls the actuator in dependence on signals from acceleration sensors arranged at the lift cage in such a manner that vibrations arising at the lift cage are suppressed, wherein setting signals from the position regulator and the acceleration regulator are summed and fed to the actuator as a summation signal.

7. The equipment according to claim 6, characterized in that the limiter unit and the feedback branch are provided for limitation and feedback of the setting signal issued by the position regulator.

8. A method of reducing vibrations of a lift cage guided at rails, wherein the cage comprises a plurality of guide elements for guiding the lift cage along the rails, a sensor for detecting positional changes of the lift cage and/or accelerations occurring at the lift cage, an actuator arranged between the lift cage and the guide elements, and a regulating device which on the basis of values transmitted from the sensor controls the actuator for changing the position of the cage relative to the rails, the method comprising the step of:

limiting an output signal produced by a regulator in the regulating equipment for controlling the actuator to a maximum value and utilizing the so-limited output signal to produce a setting signal by the regulating equipment;

wherein a difference between the output signal of the regulator and the limited output signal is calculated and fed back to the regulator as an additional input signal; and wherein the regulator is constructed in such a manner that the difference which is fed back remains as small as possible.

9. The method according to claim 8, further comprising the step of time-delaying the feedback of the difference to the regulator.

10. The method according to claim 9, characterized in that the regulating equipment is operated a in time-discrete manner, wherein the feedback is delayed by a scanning period.

11. The method according to claim 8, 9 or 10, characterized in that the maximum value to which the output signal issued by the regulator is limited is temperature-dependent.

12. The method according to claim 11, characterized in that the maximum value depends on a temperature of the actuator.

13. The method according to claim 8, 9 or 10, characterized in that the regulating equipment comprises a position regulator which controls the actuator in dependence on signals from position sensors arranged at the lift cage in such a manner that the guide elements adopt a predetermined position and an acceleration regulator which controls the actuator in dependence on signals from acceleration sensors arranged at the lift cage in such a manner that vibrations arising at the lift cage are suppressed, the method further comprising the step of summing setting signals from the position regulator and acceleration regulator and feeding the summed signals to the actuator as a summation signal.

14. The method according to claim 13, characterized in that only the setting signal of the position regulator is limited to a maximum value and fed back to the position regulator.

* * * * *